US006285338B1

(12) United States Patent
Bai et al.

(10) Patent No.: US 6,285,338 B1
(45) Date of Patent: Sep. 4, 2001

(54) METHOD AND APPARATUS FOR ELIMINATING KEYHOLE PROBLEM OF AN AZIMUTH-ELEVATION GIMBAL ANTENNA

(75) Inventors: Monty W. Bai, Scottsdale; Keith A. Kingston, Mesa; Hugh R. Malone, Phoenix; John G. Doggett, Jr., Chandler; Ronald P. Vidano, Scottsdale; Earl R. Yingling, Chandler, all of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/493,824

(22) Filed: Jan. 28, 2000

(51) Int. Cl.[7] ..... H01Q 3/00
(52) U.S. Cl. ..... 343/882; 343/880
(58) Field of Search ..... 343/882, 878, 343/757, 880

(56) References Cited

U.S. PATENT DOCUMENTS 4,562,441 * 12/1985 Beretta et al. ..... 343/781 P
4,786,912 * 11/1988 Brown et al. ..... 343/761
5,479,181 * 12/1995 Simpson ..... 343/882
5,850,199 * 12/1998 Wan et al. ..... 343/757

* cited by examiner

*Primary Examiner*—Tan Ho
*Assistant Examiner*—James Clinger
(74) *Attorney, Agent, or Firm*—Bradley J. Botsch; Frank J. Bogacz

(57) ABSTRACT

The present invention provides two approaches for eliminating a keyhole problem associated with an azimuth-elevation gimbal antenna which is a problem that occurs when the antennae is tracking a satellite vehicle that is substantially directly overhead, i.e., the satellite vehicle is near the zenith position. At such a point, the azimuth motor of the gimbal antenna must turn very rapidly when the satellite passes through such near zenith position. A first approach involves tilting up one of the elevation axis joints when the antenna points at or near its zenith position such that the pointing angle may be altered by a predetermined angle, for example around 0.5° to 1°, from the zenith position. A second approach involves tilting the secondary reflector of the cassegrain antenna such that the pointing direction of the antenna may be altered by a predetermined angle.

2 Claims, 7 Drawing Sheets

METHOD AND APPARATUS FOR ELIMINATING KEYHOLE PROBLEM OF AN AZIMUTH-ELEVATION GIMBAL ANTENNA

BACKGROUND OF THE INVENTION

This invention relates to gimbal antennas, and in particular, to eliminating the keyhole problem associated with azimuth-elevation gimbal antennas at their zenith position which requires extremely high angular acceleration motion of the azimuth motor during tracking a satellite near its zenith position.

Gimbal antennas are used for transmitting and receiving electrical signals to and from satellite vehicles. One type of gimbal antenna is known as the X-Y gimbal antennae. Such a gimbal antenna has the ability to rotate about the X and Y axes which are orthogonal to each other but not necessarily coplanar. Such X-Y gimbal antennas have a typically large sweep volume and, thus, are typically large in size for a given antenna aperture. Despite the disadvantage of the size, the X-Y gimbal antenna is rather common primarily because it does not have the keyhole problem near its zenith position.

Another type of gimbal is known as the azimuth-elevation gimbal antenna. Such a gimbal antenna is advantageous because it typically has a substantially smaller sweep volume than a corresponding X-Y gimbal antenna thereby allowing for an overall smaller antenna structure. An azimuth-elevation gimbal antenna is an antenna that is capable of rotating in two directions. The first rotational direction is in an azimuth direction which involves rotation of the antenna structure in a turntable motion in order to track the azimuth angle of a satellite vehicle. The second rotational direction is in the elevation direction which occurs by rotating the structure according to an elevation angle of a satellite. However, the keyhole problem with azimuth-elevation gimbal antennas occurs when the antenna is tracking a movable object, such as a satellite vehicle, near its zenith position, which is basically when the satellite vehicle is directly overhead. In this case, the azimuth motor hardly turns until the satellite approaches the zenith position and then the motor turns nearly 180 degrees within a short period as the satellite crosses the zenith position. FIG. 11 better illustrates the keyhole problem as the satellite is tracked from position 1 to the zenith position 2 and then to position 3 in the satellite motion plane. An azimuth-elevation gimbal antenna will successfully track when the satellite motion plane is exactly the same plane as the satellite-tracking plane. However; when the satellite motion plane and satellite tracking planes are slightly off co-planar, the keyhole problem is experienced whereby the azimuth motor must perform with extremely high rotational velocity. This rapid rotational motion of the antenna causes substantial problems in the acceleration of the gimbal antenna and could even cause its destruction.

Accordingly, a need exists for an improved method and apparatus for alleviating the keyhole problem associated with azimuth-elevation gimbal antennas thereby providing a suitable antenna system for tracking satellite vehicles while having a substantially smaller sweep volume and overall size than a corresponding X-Y gimbal antenna.

DETAILED DESCRIPTION OF THE DRAWINGS

Figure 11:
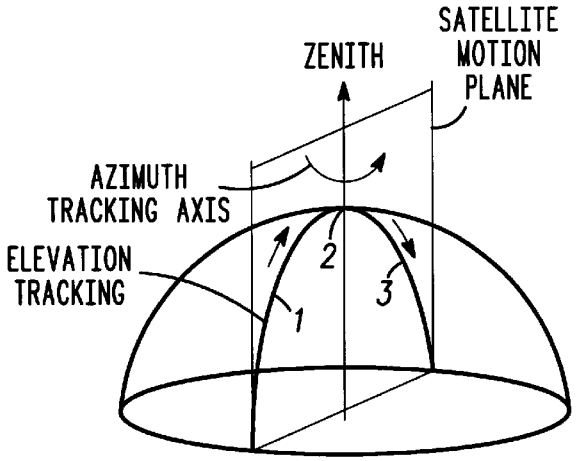
FIG. 11 is a pictorial diagram illustrating the keyhole problem that occurs as a satellite is tracked from position 1 to the zenith position 2 and then to position 3 in the satellite motion plane.
Figure 12:
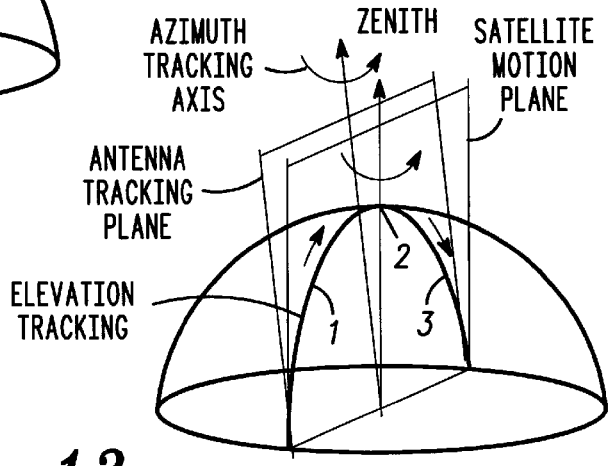
FIG. 12 is a pictorial diagram illustrating the concept of the present invention for eliminating the keyhole problem by enabling that the antenna tracking plane and the satellite tracking plane are not co-planar as the satellite approaches zenith.
Figure 13:
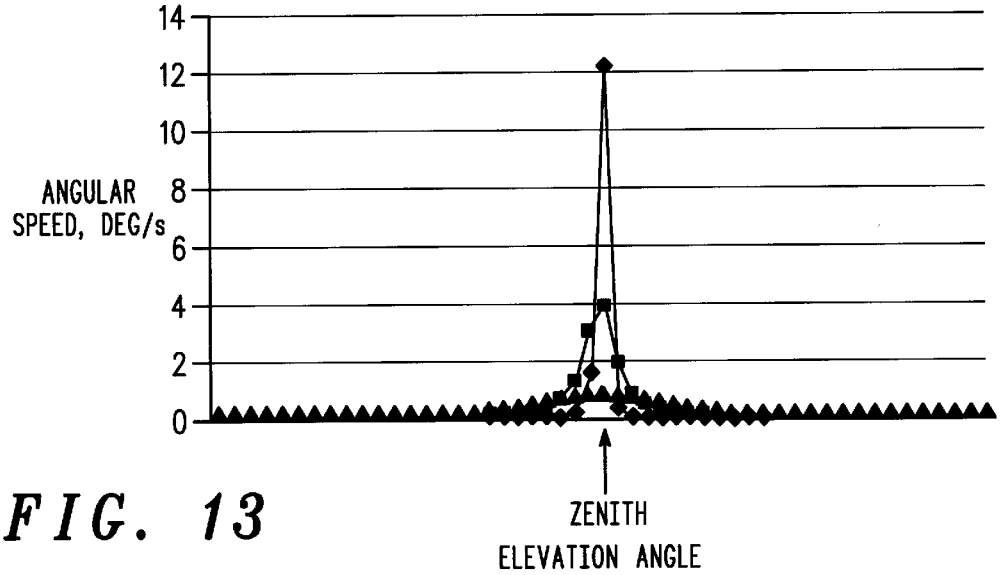
FIG. 13 is a plot showing the magnitude of the key-hole problem that is solved by the present invention.

The present invention provides a method and apparatus for eliminating a keyhole problem associated with an azimuth-elevation gimbal antenna which is a problem that occurs when the antenna is tracking a satellite vehicle that is substantially directly overhead, i.e., the satellite vehicle's near zenith position. At such a point, the azimuth motor of the gimbal antenna must turn very rapidly when the satellite passes through such near zenith position as was illustrated in FIG. 11. This keyhole problem has made azimuth-elevation gimbal antennas undesirable for use in tracking satellite vehicles passing overhead. However, the present invention provides two approaches to eliminating the keyhole problem associated with such azimuth-elevation gimbal antennas. FIG. 12 illustrates the concept of eliminating the keyhole problem. This concept requires the recognition that when the antenna tracking plane and the satellite tracking plane are not co-planar as the satellite approaches zenith, then the azimuth tracking motion may occur at a much slower rotational velocity compared to the case when the satellite and tracking planes are the same. The present invention makes use of this principle to implement a solution to tracking through zenith by displacing the azimuth tracking axis a few degrees from the zenith axis. FIG. 13 illustrates the magnitude of the key-hole problem that is solved by the present invention. The vertical axis of FIG. 13 shows the azimuth angular rotation velocity in degrees per second, while the horizontal axis shows the time for an elevation track at three different angles of displacement for the satellite motion plane compared to antenna tracking plane. As can be seen from FIG. 13, at a very small non-co-planar angle of 0.1 degrees, the angular rotation reaches 12 degrees per second as the satellite passes the near zenith condition. However, at a non-co-planar angle of 1 degree, the angular rotation reaches only 4 degrees per second when the satellite passes the near zenith condition. Further, at 5 degrees non-co-planar angle the maximum angular rotation which the azimuth motor must sustain is 1 degree per second near zenith.

The present invention provides two approaches to allow the antenna tracking plane to be in a separate plane with that of the satellite tracking plane. Briefly, the first approach is implemented by tilting one of the elevation axis joints such that the two elevation axis joints lie in separate horizontal planes when the antenna points near its zenith position. This alters the pointing direction of the antenna by a predetermined relatively small angle, for example, around 0.5° to 1°. Other angles, however, may be used to overcome the keyhole problem. This tilting motion may be achieved by using a linear actuator. This tilting motion may also be used for searching for the maximum satellite signal strength while tracking satellite vehicles near overhead.

The second approach may be implemented by tilting the secondary reflector of the cassegrain antenna such that the two sides of the secondary reflector lie in separate horizontal planes when the antenna points at or near its zenith position. This alters the pointing direction of the antenna by a predetermined relatively small angle, for example, around 0.5° to 1°. This tilting of the secondary reflector may be achieved by using a piezo-ceramic beam actuator such as bimorphs beams, or by the use of small linear actuators. In either approach the keyhole problem is eliminated thereby making the azimuth-elevation gimbal antenna useful for tracking satellite vehicles near overhead.

Figure 1:
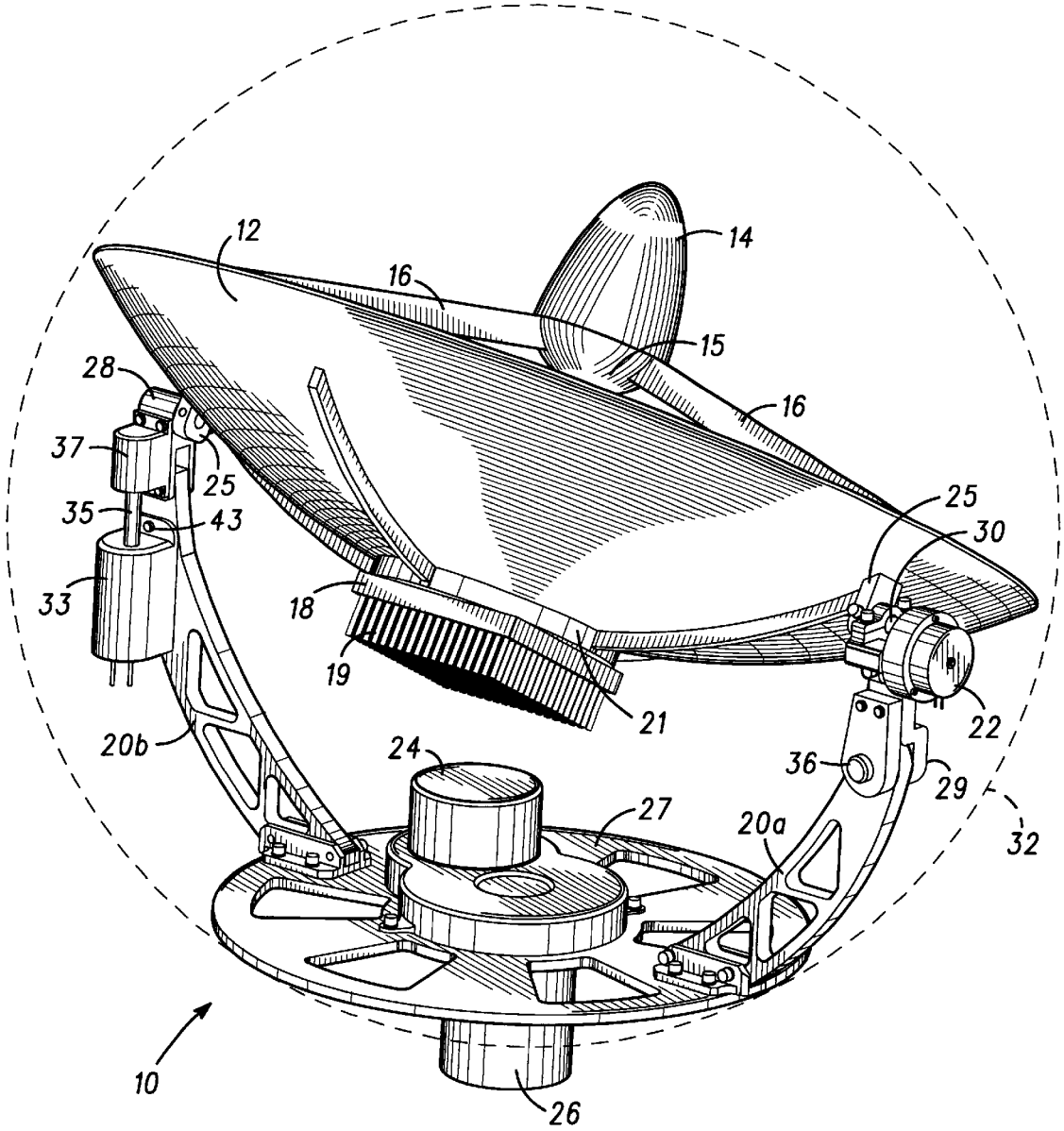
FIG. 1 is a pictorial diagram illustrating an azimuth elevation gimbal antenna in accordance with a first embodiment of the present invention wherein the primary reflector of the antenna is tilted with respect to a horizontal plane.

Referring to FIG. 1, a pictorial diagram illustrating an azimuth elevation gimbal antenna in accordance with a first embodiment of the present invention is shown. In accordance with the first embodiment, the primary reflector (12) of the antenna is tilted with respect to a horizontal plane thereby allowing for the pointing angle to be altered by a predetermined angle, for example 0.5°–1° when the satellite is overhead. FIG. 1 illustrates antenna 10 comprised of a primary reflector 12 that is affixed to a mounting base 21 whereby mounting base 21 is coupled to transmitter 18 and heatsink 19.

Antenna 10 also includes receiver 14 that includes a secondary cassegrain reflector/subreflector 15. Subreflector 15 is coupled to the inside dish of primary reflector 12 via support members 16. It is understood that although subreflector 15 is shown as a cassegrain reflector, it could also take the form of a gregorian reflector.

Primary reflector 12 is coupled to a mounting structure for support via two connection points. The first connection point, as shown on the right side of FIG. 1, shows connector 25 that connects primary reflector 12 to elevation pivot joint 30 which is coupled to and driven by motor 22. Motor 22 provides the drive for adjusting the elevation angle of primary reflector 12. Motor 22 is coupled to pivot mechanism 29 that revolves around axis 36 for allowing horizontal movement when the primary reflector is moved up or down with respect to the horizontal plane. The details of this connection is better illustrated in FIG. 4 and described hereinafter.

Pivot mechanism 29 is coupled to mounting member 20*a*, which in turn is coupled to rotatable mounting base 27. Rotatable mounting base 27 in turn is coupled to fixed mounting base 26 for use with mounting antenna 10 to a vertical post, for example.

Figure 2:
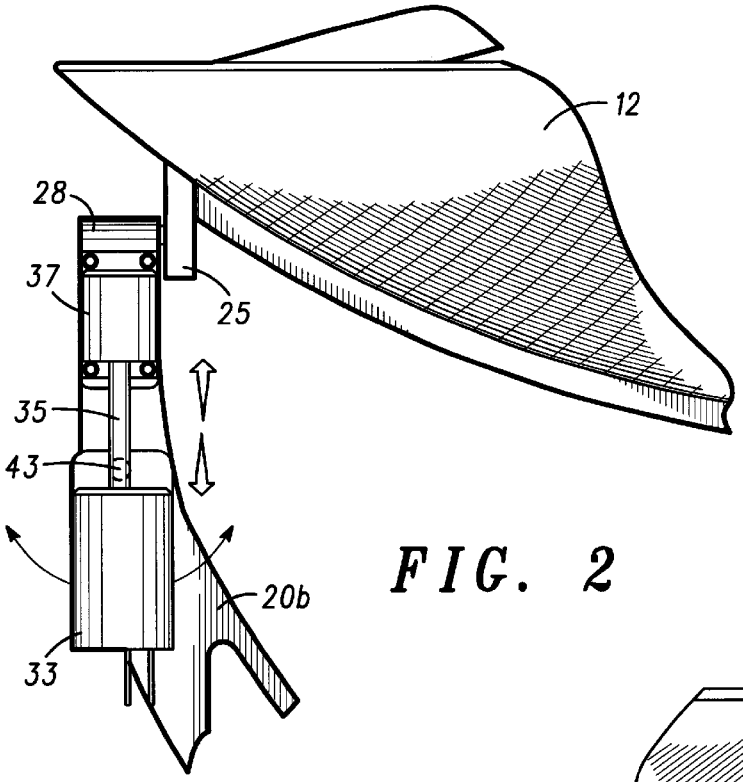
FIG. 2 is a partial pictorial diagram of the antenna of FIG. 1 illustrating, in more detail, a horizontal pivot point associated with the azimuth motor to prevent binding of the drive mechanism as the primary reflector is moved up or down.
Figure 3:
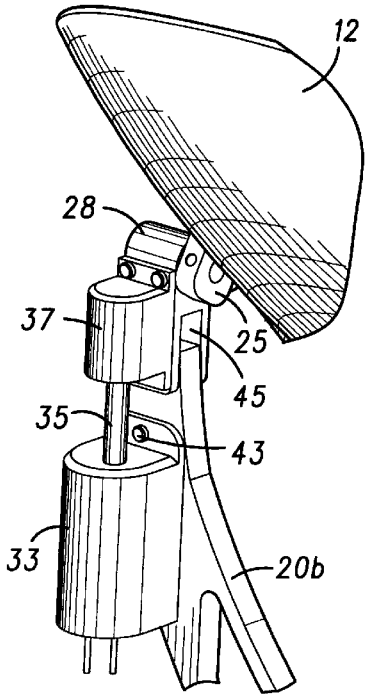
FIG. 3 is a pictorial diagram of the antenna of FIG. 1 illustrating, in more detail, the saddle arrangement for allowing the drive mechanism associated with the azimuth motor to freely move up or down over the mounting member.
Figure 4:
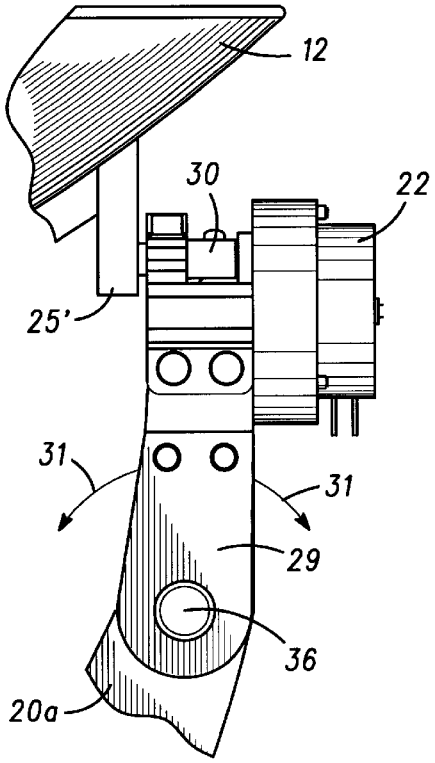
FIG. 4 is a partial pictorial diagram of the antenna of FIG. 1 illustrating, in more detail, the connection of the primary reflector to the mounting base via the elevation motor mechanism.
Figure 5:
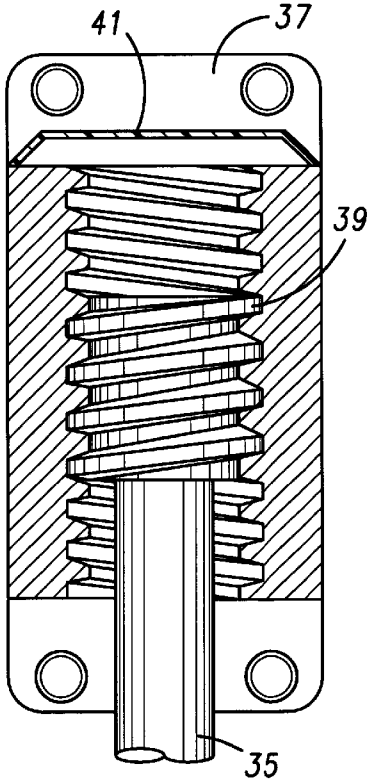
FIG. 5 is a detailed pictorial diagram illustrating an acme screw as the preferred embodiment for the drive mechanism associated with the tilting of the primary reflector.

Referring to the left connection point for primary reflector to mounting base 20*b*, there is illustrated connector 25 that is affixed to primary reflector 12 for coupling primary reflector 12 to pivot joint 28 whereby pivot joint 28 is coupled to drive mechanism 37. Referring to FIG. 5, a detailed pictorial diagram illustrating an acme screw as the preferred embodiment for the drive mechanism 37 is shown. In particular, acme screw 39 is the drive mechanism that is coupled to shaft 35, which in turn is coupled to drive motor 33. These mechanisms function to adjust the height of the left side of primary reflector 12 with respect to the horizontal plane such that the left and right sides of primary reflector 12 lie in separate horizontal planes. That is, the left and right elevation pivot joints 28 and 22, respectively, 12 lie in separate horizontal planes with respect to each other. It is understood that this drive mechanism has the ability to adjust the left side of primary reflector in an upward or downward direction with respect to the horizontal plane thereby creating either an upward or downward tilt of primary reflector 12. Moreover, although only the left side of primary reflector 12 is shown to move up or down, it is understood that the right side and/or both the left side and right side could be adjusted to create a tilt of primary reflector 12. FIGS. 2–4 illustrate in more detail the structure and operation associated with this left connection point.

Referring now to FIG. 2, a partial pictorial diagram of the antenna of FIG. 1 is shown whereby the horizontal pivot joint 43 associated with the azimuth motor is shown in more detail to prevent binding of the drive mechanism as the primary reflector 12 is moved up or down. In particular, FIG. 2 illustrates horizontal pivot joint 43 associated with motor 33 for allowing motor 33 to pivot in a horizontal direction to prevent binding of acme screw 39 as the primary reflector 12 is adjusted up or down. Without such pivot joint, the tilting of the primary reflector 12 would create an undesirable stress on acme screw 39 by providing an undesirable torque to the left or right.

Referring to FIG. 3, there is illustrated another partial pictorial diagram of the antenna of FIG. 1 illustrating in more detail the saddle arrangement for allowing the drive mechanism 37 associated with the azimuth motor to freely move up and down over the mounting member 20*b*. In particular, area 45 depicts the saddle arrangement between drive mechanism 37 and mounting base 20*b* for allowing drive mechanism 37 to freely move up and down over the mounting base 20*b* as motor 33 adjusts the height of the left side of the primary reflector 12.

Referring now to FIG. 4, there is illustrated a partial pictorial diagram of the antenna 10 illustrating in more detail the connection of the primary reflector to the mounting base via the elevation angle motor mechanism. As shown in FIG.

4, elevation motor 22 turns pivot joint 30 to allow for adjustment of the elevation angle of the antenna. Pivot mechanism 29 is coupled to motor 22 and pivots around its axis 36 with respect to mounting base 20a for allowing motor 22 to pivot around pivot joint 43 such that reflector 12 may be tilted through a horizontal movement without motor 33 or its associated drive mechanism 37 from binding. Accordingly, anchor pivot 36, motor 22 and reflector 12 move through an arc to achieve the horizontal deflection as shown by arrows 31.

Figure 6:
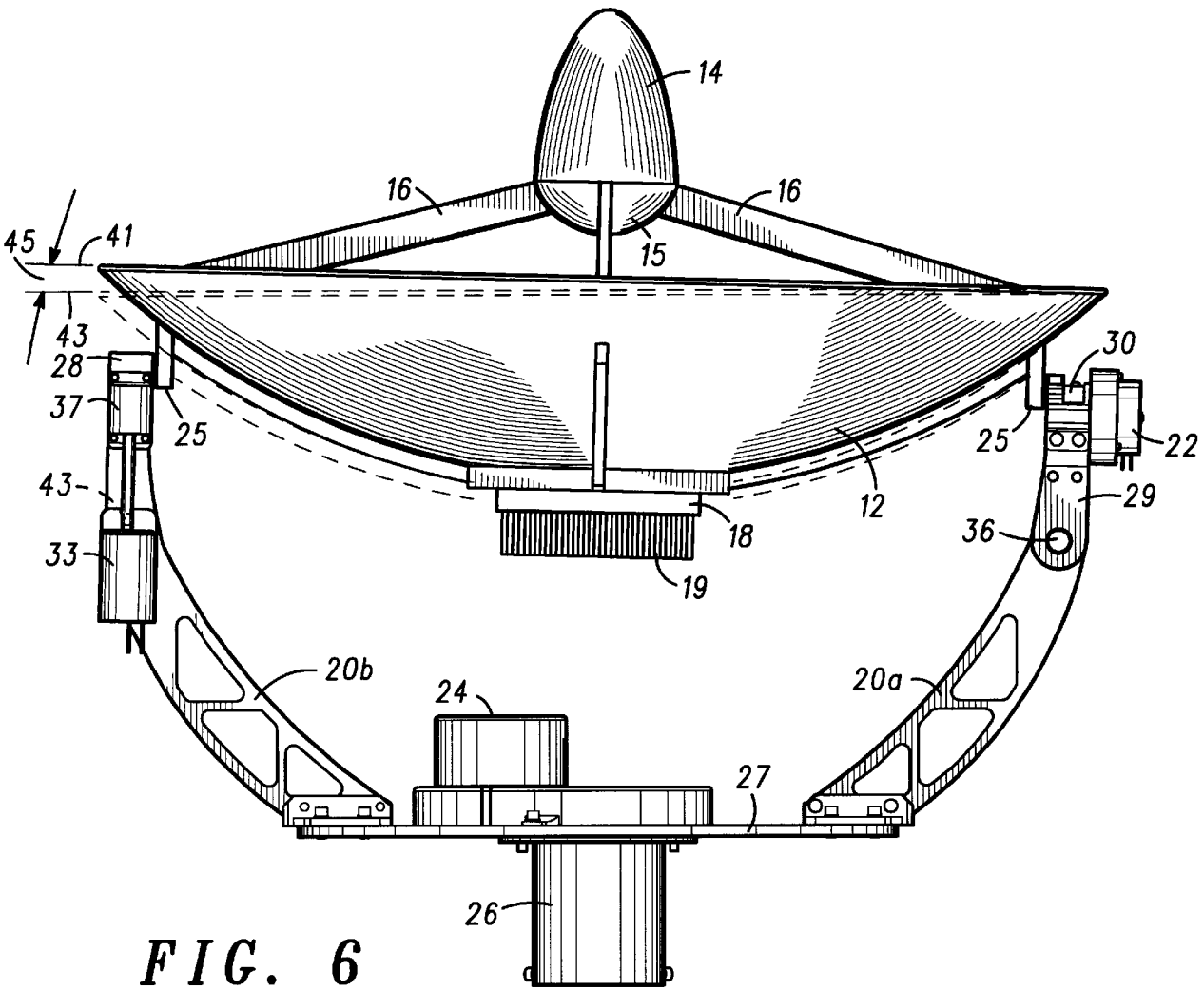
FIG. 6 is a pictorial diagram illustrating the primary reflector adjusted in a horizontal position and then in a slightly tilted position in accordance with the first embodiment of the present invention.

Referring now to FIG. 6, there is shown a pictorial diagram illustrating the primary reflector 12 adjusted in a horizontal position 41 and then in a slightly tilted position 43 in accordance with the first embodiment of the present invention. In particular, position 41 illustrates primary reflector 12 in a substantially parallel position with the horizon plane. However, position 43 illustrates primary reflector 12 being tilted downward as controlled by motor 33 so as to provide a left downward tilt of primary reflector 12 with respect to the horizontal plane. That is, the left and right elevation pivot joints 28 and 22, respectively, will lie in different horizontal planes with respect to each other. It is understood that by providing such tilt to primary reflector 12, the keyhole problem associated with azimuth-elevation antenna structures is substantially eliminated. It is also worth noting that although FIG. 6 illustrates that the primary reflector 12 is positioned in a left downward tilted angle, it is understood that the motor 33 could have provided a left upward tilt if desired.

Figure 7:
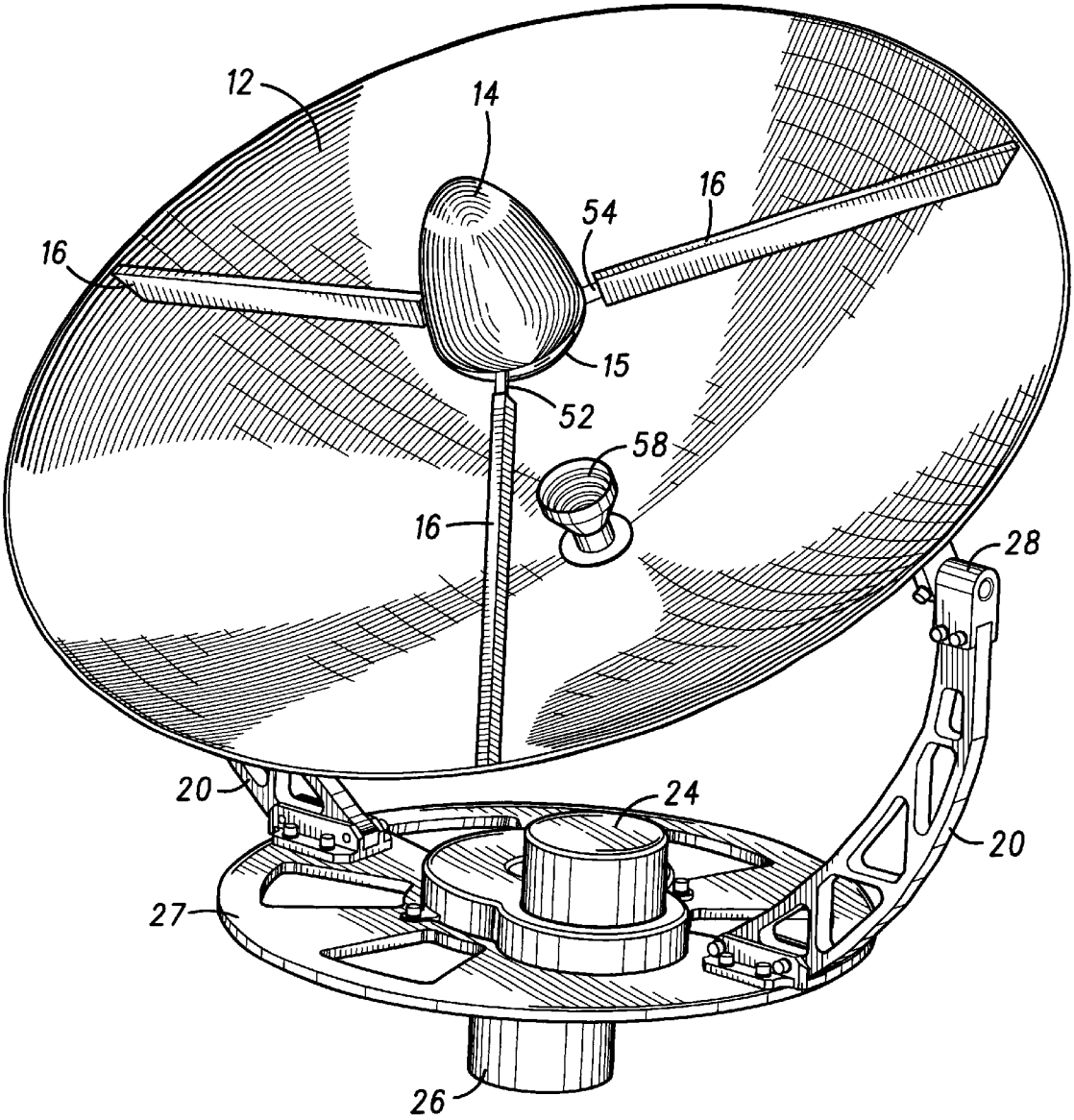
FIG. 7 is a pictorial diagram illustrating an azimuth-elevation gimbal antenna in accordance with a second embodiment of the present invention wherein the receiving element of the antenna is tilted with respect to a horizontal plane

Referring now to FIG. 7, there is shown a pictorial diagram illustrating an azimuth elevation gimbal antenna in accordance with a second embodiment of the present invention. This second embodiment of the present invention addresses the tilting of the receiver 14 of the antenna with respect to a horizontal plane, as opposed to the tilting the primary reflector as was described with respect to FIGS. 1–6. In particular, FIG. 7 additionally illustrates piezo device 52 coupled between one or more members 16 and receiver 14. Also, elastomeric mounts 54 are coupled between receiver 14 and one or more members 16 for suspending receiver 14 between the members 16. Focal pointfeed 58 is disposed within primary reflector 12 for allowing signals to be transmitted from transmitter 18 (shown in FIG. 1) through primary reflector 12 and to reflect off secondary reflector 15 and then back off to primary reflector 12 for eventual transmission to a destination device (not shown) such as a satellite.

Figure 8:
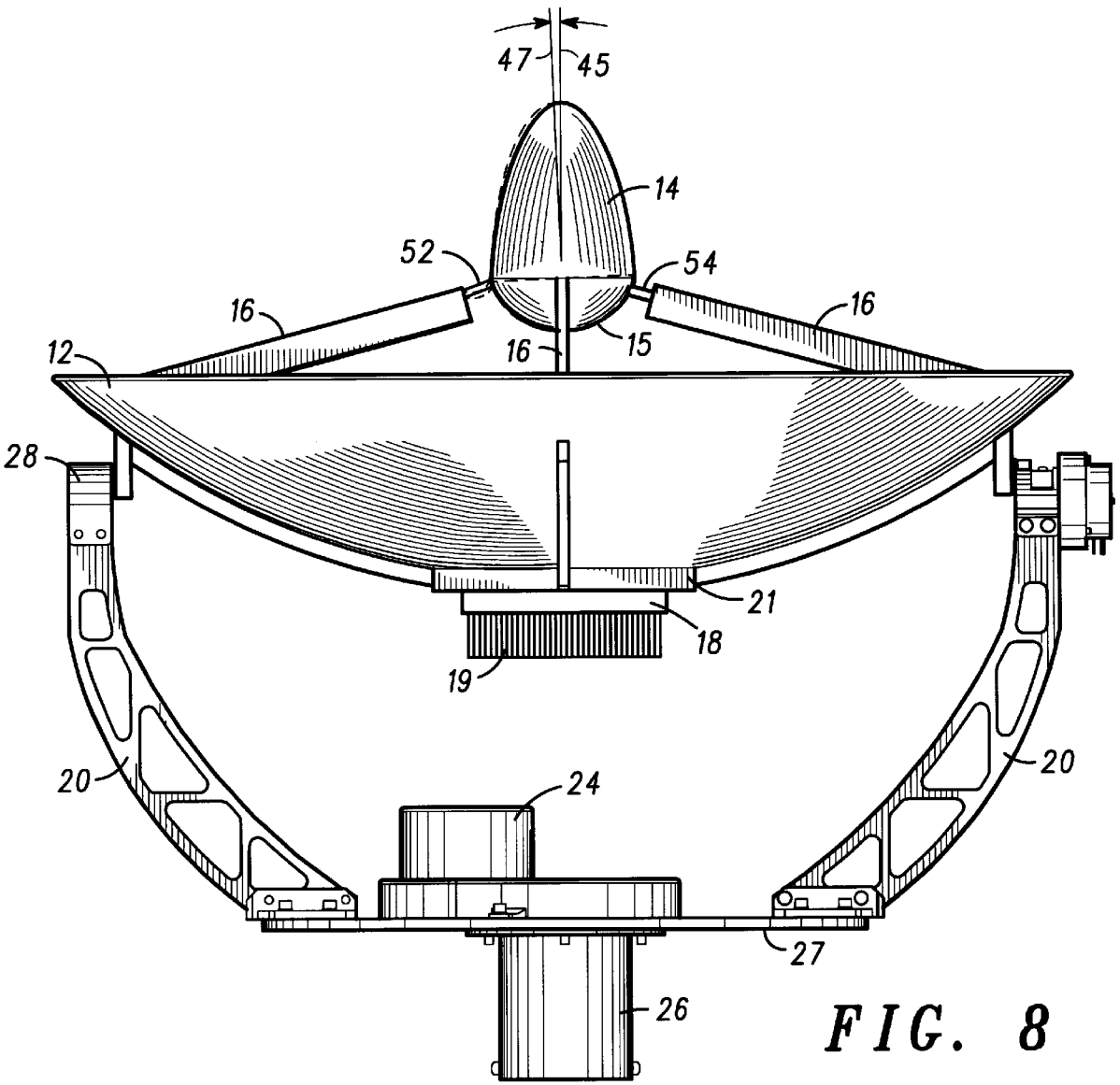
FIG. 8 is a pictorial diagram illustrating the receiving unit adjusted in a horizontal position and then in a slightly tilted position in accordance with the second embodiment of the present invention.

Referring now to FIG. 8, there is shown a pictorial diagram illustrating the receiver 14 adjusted in a horizontal position and then in a slightly titled position in accordance with the second embodiment of the present invention. In particular, as a voltage is applied to piezo device 52, device 52 will bend and cause receiver 14 to tilt. For example, with no voltage applied to piezo device 52, receiver 14 may be in a substantially horizontal and thus substantially vertical position as illustrated by reference line 45. However, as a voltage is applied to piezo device 52 which causes piezo device 52 to bend, receiver 14 will tilt in a direction as indicated by line 47. This corresponds to a horizontal tilt of receiver 14.

Figure 9:
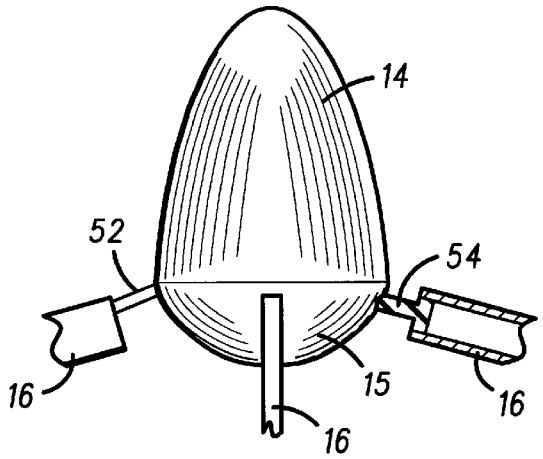
FIG. 9 is a partial pictorial diagram illustrating, in more detail, the connection of the elastomeric mount inside of the support members.

Referring to FIG. 9, there is a partial pictorial diagram illustrating in more detail the connection of elastomeric mounts 54 to the inside of the support member 16. Elastomeric mounts 54 provide necessary flexibility such that when piezo device 52 bends, an undue stress is not placed upon support members 16 thereby allowing receiver 14 to move freely corresponding to movement associated with piezo device 52.

Figure 10:
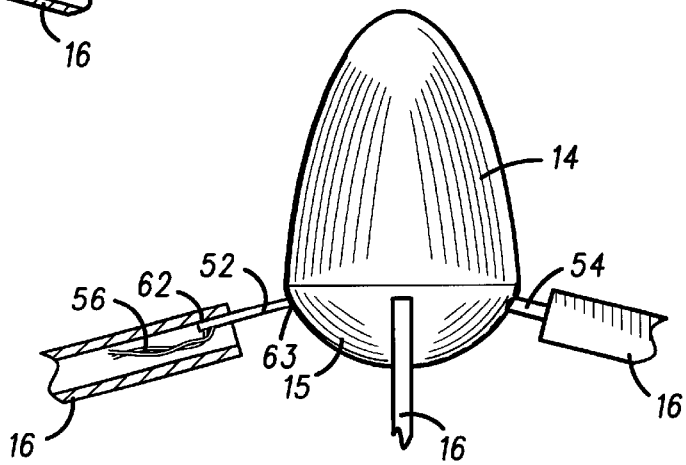
FIG. 10 is a partial pictorial diagram illustrating, in more detail, the connection of the piezo device inside of the support members
Figure 14:
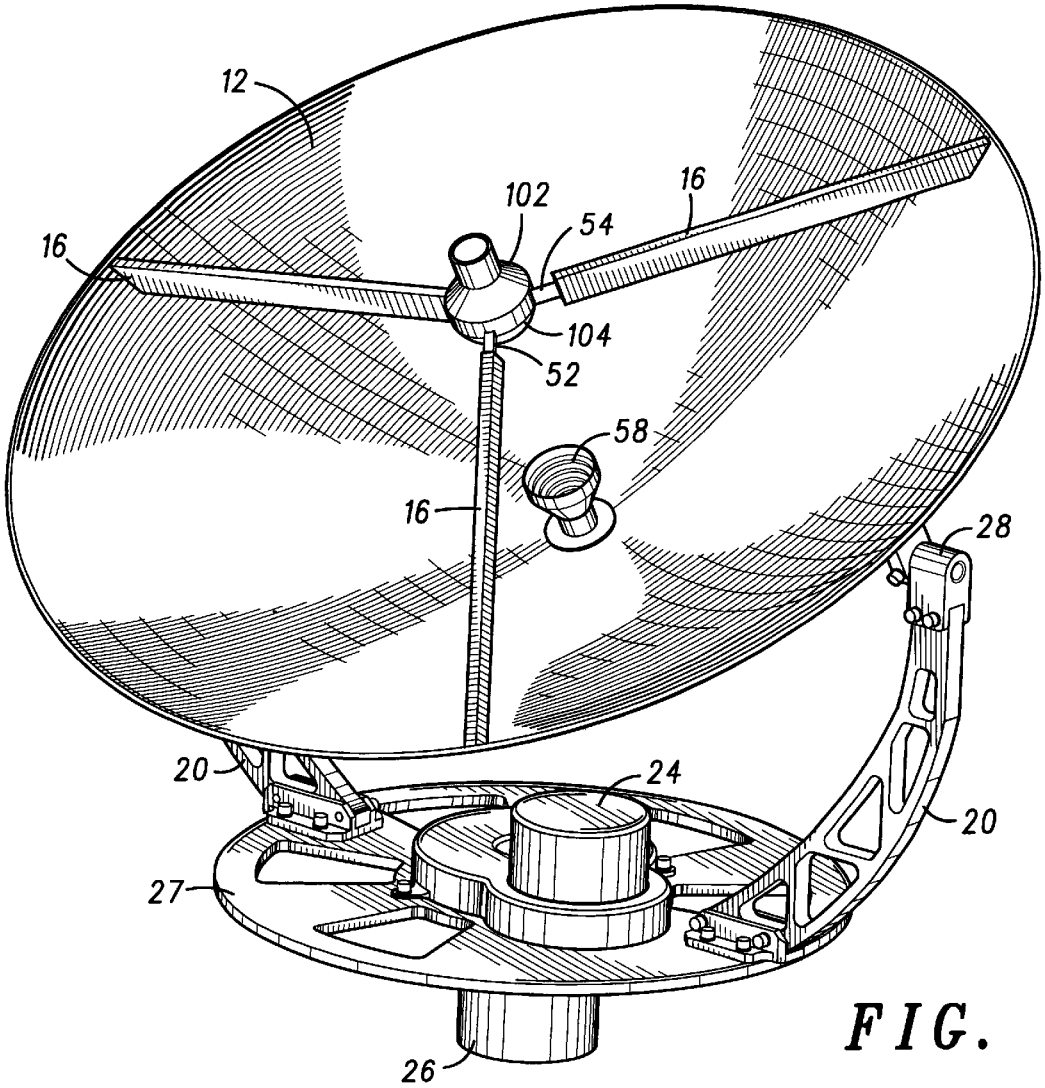
FIG. 14 is a pictorial diagram illustrating an alternate arrangement of an azimuth-elevation gimbal antenna showing a subreflector as being supported above a primary reflector.

Referring to FIG. 10, there is illustrated a partial pictorial diagram showing in more detail the connection of piezo device 52 connected inside support member 16. Piezo device 52 has first and second ends 62 and 63 whereby first end 62 is attached to support member 16 and second end 63 is attached to receiver 14. Wires 56 are typically connected to an adjustable voltage source (not shown) for varying the voltage applied to piezo device 52 to cause piezo device 52 to bend. For example, referring back to FIG. 8, a predetermined voltage is applied to piezo device 52 to cause device 52 to move in a downward direction thereby causing receiver 14 to move in corresponding counter-clockwise direction. Alternately, a predetermined voltage is applied to piezo device 52 to cause device 52 to move in a upward direction thereby causing receiver 14 to move in corresponding clockwise direction. The present invention illustrates that the antenna structure includes a transmitter and a receiver as shown in FIG. 1. Referring to FIG. 14, a pictorial diagram illustrating an alternate arrangement of an azimuth-elevation gimbal antenna is shown having a subreflector being supported above a primary reflector. FIG. 14 illustrates subreflector 104 and focal pointfeed 102 as being supported above primary reflector 12 by supporting members 16. Subreflector 104 has a frequency selective surface that allows signals within the frequency range of the receiver to pass through the subreflector while reflecting other signals, such as the signals within the frequency range of the transmitter. Note that in such an embodiment, a receiver is typically coupled to focal pointfeed 104 for receiving signals passing through subreflector 102. However, antenna 12 may include only one focal pointfeed, either the focal pointfeed supported by focal pointfeed 58 or by focal pointfeed 102 such that antenna 12 would then typically operate only as a receive antenna. Further, in such an embodiment, subreflector 104 would typically not be needed.

The present invention also sets forth a method for substantially eliminating a keyhole problem associated with an azimuth-elevation gimbal antenna when tracking a movable object, such as a satellite. The azimuth-elevation gimbal antenna including a primary reflector, a gimbal structure for supporting said primary reflector, said gimbal structure including first and second rotating joints, said first and second rotating joints being coupled to said primary reflector, a first motor coupled to said gimbal structure for causing a rotation at said first and second rotating joints thereby adjusting an elevation angle of the azimuth-elevation gimbal antenna, a rotatable turntable coupled to said gimbal structure, a second motor coupled to said rotatable turntable for causing a rotation of said rotatable turntable thereby adjusting an azimuth angle of the azimuth-elevation gimbal antenna, a receiver, said receiver having a surface for reflecting signals, and a receiver structure, coupled between said receiver and said primary reflector, for supporting said receiver. The method comprising the steps of using said first and second motors to respectively adjust an elevation angle of said primary reflector and an azimuth angle of said rotatable turntable, and tilting said primary reflector when said movable object is near a zenith position of said azimuth-elevation gimbal antenna such that said first and second rotating joints lie in separate horizontal planes. Alternately, instead of tilting the primary reflector, the receiver of the antenna may be tilted.

While the invention has been described in conjunction with specific embodiments thereof, many alternatives, modifications and variations will be apparent to those of ordinary skill in the art in light of the foregoing description. Accordingly, the invention is intended to embrace all such alternatives, modifications and variations as fall within the broad scope of the appended claims.

What is claimed is:

1. An azimuth-elevation gimbal antenna, comprising:

a primary reflector;

a gimbal structure for supporting said primary reflector, said gimbal structure including first and second rotating joints, said first and second pivot joints being coupled to said primary reflector;

a first motor coupled to said gimbal structure for causing a rotation at said first and second pivot joints thereby adjusting an elevation angle of the azimuth-elevation gimbal antenna;

a rotatable turntable coupled to said gimbal structure;

a second motor coupled to said rotatable turntable for causing a rotation of said rotatable turntable thereby adjusting an azimuth angle of the azimuth-elevation gimbal antenna;

a receiver, said receiver having a surface for reflecting signals;

a receiver structure, coupled between said receiver and said primary reflector, for supporting said receiver, said receiver structure including a plurality of supporting members, each one of said plurality of supporting members being coupled between said primary reflector and said receiver such that said receiver is suspended with respect to said primary reflector; and a piezo device coupled between one of said plurality of supporting members and said receiver for causing a tilt to said receiver.

2. The azimuth-elevation gimbal antenna of claim 1 further including an elastomeric mount coupled between at least one other one of said plurality of supporting members and said receiver.

* * * * *